US007438433B1

(12) United States Patent
Steadman et al.

(10) Patent No.: US 7,438,433 B1
(45) Date of Patent: Oct. 21, 2008

(54) LIGHTING FIXTURE ASSEMBLY WITH EASY ACCESS JUNCTION BOX

(75) Inventors: Connie A. Steadman, Taylors, SC (US); Ronald C. Newbold, Roebuck, SC (US); Thomas W. Fool, Taylors, SC (US)

(73) Assignee: Hubbell Incorporated, Orange, CT (US)

( * ) Notice: Subject to any disclaimer, the term of this patent is extended or adjusted under 35 U.S.C. 154(b) by 0 days.

(21) Appl. No.: 11/896,480

(22) Filed: Aug. 31, 2007

(51) Int. Cl.
*F21S 13/02* (2006.01)

(52) U.S. Cl. ..... 362/147; 362/640

(58) Field of Classification Search ..... 362/145, 362/147, 148, 150, 149, 640, 404
See application file for complete search history.

(56) References Cited

U.S. PATENT DOCUMENTS

| | | | |
|---|---|---|---|
| 4,039,822 | A | 8/1977 | Chan et al. |
| 4,327,403 | A | 4/1982 | Capostagno et al. |
| 4,408,262 | A | 10/1983 | Kusmer |
| 4,566,057 | A | 1/1986 | Druffel |
| 4,858,067 | A | 8/1989 | Rochelle et al. |
| 5,410,462 | A | 4/1995 | Wolfe |
| 5,588,737 | A | 12/1996 | Kusmer |
| 5,800,050 | A | 9/1998 | Leadford |
| 5,857,766 | A | 1/1999 | Sieczkowski |
| 5,957,574 | A | 9/1999 | Hentz et al. |
| 6,350,047 | B1 | 2/2002 | Ng et al. |
| 6,431,723 | B1 | 8/2002 | Schubert et al. |
| 6,659,627 | B2 | 12/2003 | Caluori |
| 6,994,457 | B2 | 2/2006 | Lee |

FOREIGN PATENT DOCUMENTS

| | | |
|---|---|---|
| JP | 05028818 | 2/1993 |

*Primary Examiner*—Laura Tso
(74) *Attorney, Agent, or Firm*—Jenae C Avallone; Mark S. Bicks; Alfred N. Goodman

(57) ABSTRACT

A lighting fixture assembly with easy access to a junction box or electrical box having a mounting frame adapted to be coupled to a wall in an architectural space. Through an opening in the frame or ceiling, a luminaire is coupled to the mounting frame for projecting light through the opening. A support, such as a substantially U-shaped bracket having legs with first and second lengths, is coupled to the mounting frame and to the electrical box for supporting the electrical box in a position tilted towards the opening. This provides easy access and viewing through the opening from below the mounting frame when the luminaire is not located in the opening.

20 Claims, 7 Drawing Sheets

LIGHTING FIXTURE ASSEMBLY WITH EASY ACCESS JUNCTION BOX

FIELD OF THE INVENTION

The present invention relates to a lighting fixture assembly having a mounting frame adapted to be coupled to a wall in an architectural space. Through an opening in the mounting frame, a luminaire is coupled to the mounting frame and projects light through the opening. A support, such as a bracket, is coupled to the mounting frame and to an electrical box to support the electrical box in a position tilted towards the opening. This provides easy access to and viewing of the electrical box and the contents thereof through the opening from below the mounting frame when the luminaire is not located in the opening.

BACKGROUND OF THE INVENTION

Conventional recessed lighting fixture assemblies are often installed behind a mounting frame or ceiling and, therefore, their accessibility to end-users and inspectors is limited. It is costly and time consuming to inspect an electrical box, ballast, transformer, or other similar type electrical device located above the ceiling and connected to the lighting fixture assembly. In addition, the electrical boxes are usually in a position that makes them difficult to access and view from below the ceiling or mounting frame through the opening in the ceiling or mounting frame.

Other systems used generally as recessed lighting fixture assemblies are disclosed in the following: U.S. Pat. No. 5,800,050 to Leadford; U.S. Pat. No. 6,350,047 to Ng et al.; and U.S. Pat. No. 6,431,723 to Schubert et al.

Accordingly, a need exists for an easily accessible electrical box, ballast, transformer, or other similar type electrical device of a lighting fixture assembly connected to a ceiling or mounting frame for easy and quick inspection and servicing. Preferably, the electrical box and the contents thereof are visible and accessible from below the ceiling through an opening in the ceiling and located adjacent to that opening.

SUMMARY OF THE INVENTION

Accordingly, an object of the present invention is to provide a lighting fixture assembly recessed behind a planar surface, such as a ceiling.

Another object of the invention is to provide a lighting assembly such as a recessed luminaire that reflects light through an opening in a planar surface while simultaneously concealing the light source.

A further object of the invention is to provide a mechanism for tilting an electrical box towards an opening in a planar surface for easy access and viewing.

Still another object of the invention is to provide a method of powering a recessed luminaire whereby all of the electrical components are above a mounting frame and access to the electrical components is limited through an opening in the mounting frame from below the mounting frame.

A further object of the invention is to provide a recessed lighting fixture assembly coupled to a mounting frame adapted to be coupled to a wall in an architectural space such that inspectors, installers, and maintenance workers are able to relatively easily (1) read the information on ballast labels, transformer labels, other electrical device labels, and electrical box labels, (2) inspect wiring methods used during lighting fixture assembly installation, and (3) remove and replace the electrical box cover, wires, ballast, transformer, and other electrical devices through the opening in the mounting frame from below the mounting frame.

The foregoing objects are basically attained by providing a lighting fixture assembly having a mounting frame adapted to be coupled to a wall in an architectural space. Through an opening in the mounting frame, a luminaire is coupled to the mounting frame and projects light through the opening. A support, such as a bracket, is coupled to the mounting frame and to an electrical box for supporting the electrical box in a position tilted towards the opening.

By forming the lighting fixture assembly in this manner, the electrical box and the contents thereof are easily accessible and viewable through the opening in the mounting frame from below the mounting frame and the end-user can access the lighting fixture assembly through the opening in the mounting frame from below the mounting frame.

As used in this application, the terms "top", "bottom", "front", "rear", and "side" are intended to facilitate the description of the lighting fixture assembly having an easy access electrical or junction box, and are not intended to limit the description of the lighting fixture assembly to any particular orientation.

Other objects, advantages, and salient features of the present invention will become apparent from the following detailed description, which, taken in conjunction with the annexed drawings, discloses preferred embodiments of the invention.

BRIEF DESCRIPTION OF THE DRAWINGS

Referring to the drawings which form a part of this disclosure.

Throughout the drawings, like reference numerals will be understood to refer to like parts, components, and structures.

DETAILED DESCRIPTION OF THE INVENTION

Figure 1:
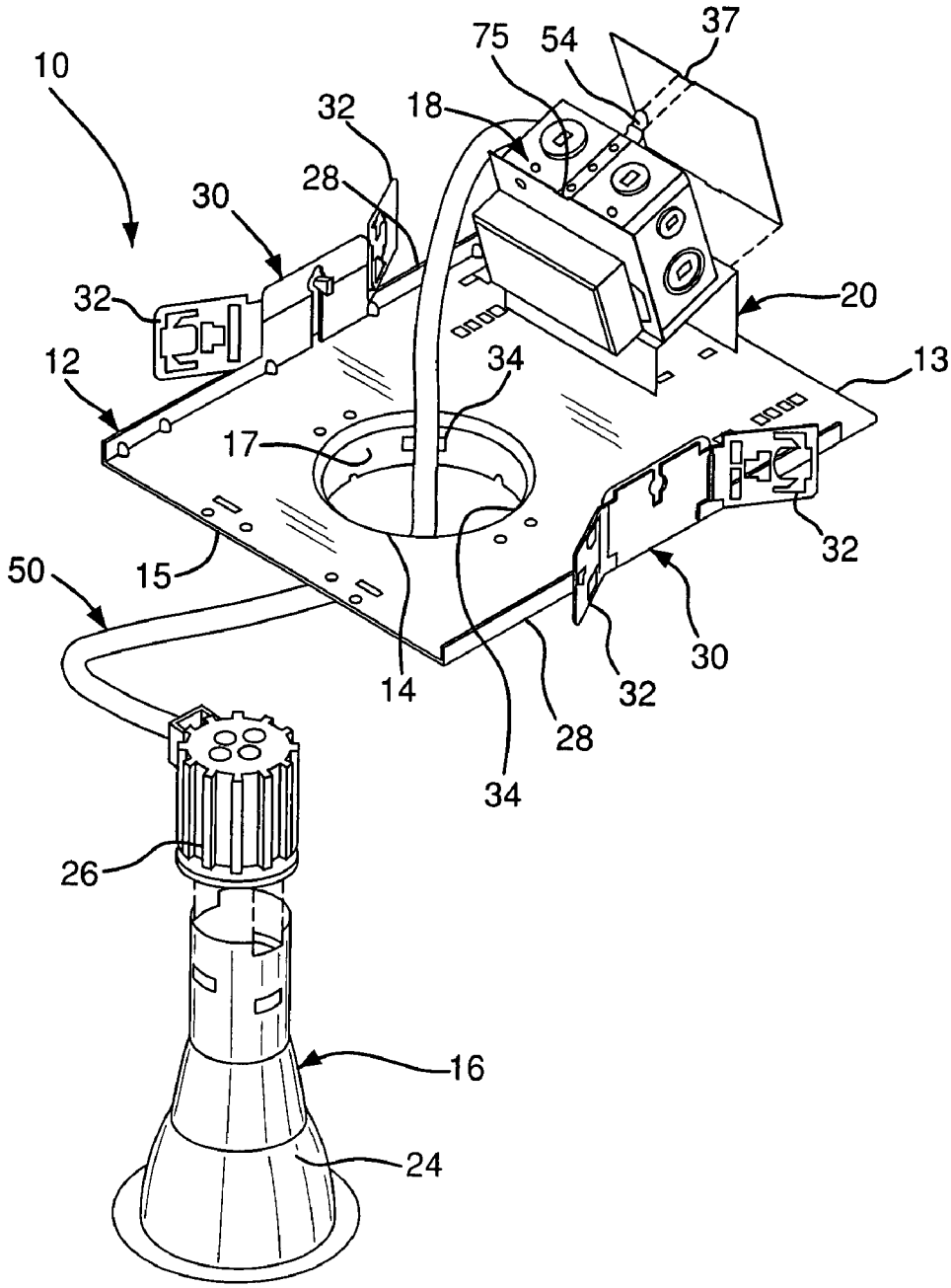
FIG. 1 is a top, perspective view of the lighting fixture assembly according to an embodiment of the present invention with a luminaire connected to an electrical box.
Figure 8:
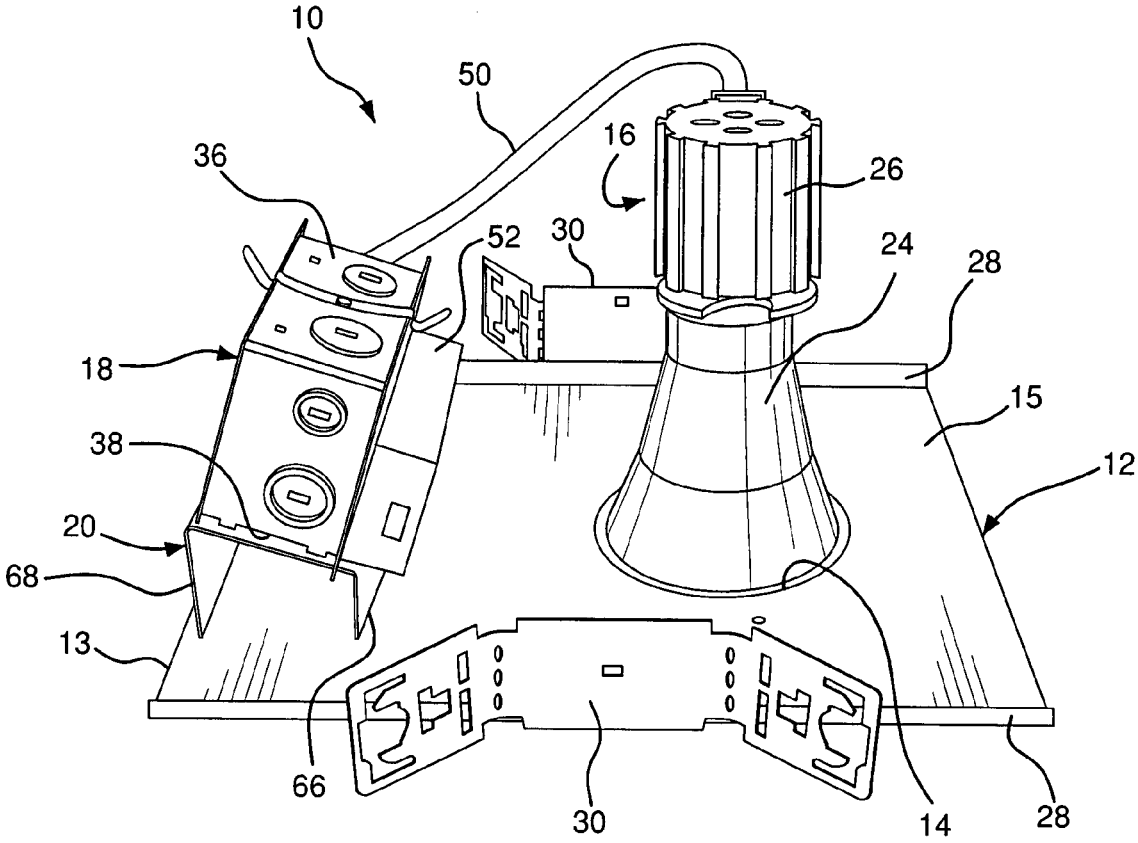
FIG. 8 is a side perspective view of the lighting fixture assembly as seen in FIGS. 1-7.

Turning to FIGS. 1 and 8, a lighting fixture assembly 10 includes a mounting frame 12 adapted to be coupled to a wall in an architectural space. A luminaire 16 is coupled to the mounting frame 12 through an opening 14 in the mounting frame 12. A support, such as a mounting bracket 20, also coupled to the mounting frame 12, supports an electrical box or junction box 18 in a position tilted towards the opening 14. This orientation provides easy access to and viewing of the junction box 18, as well as any wires, transformers, ballasts, or other similar type electrical device 52 coupled thereto, through the opening 14 from below the mounting frame 12.

Figure 2:
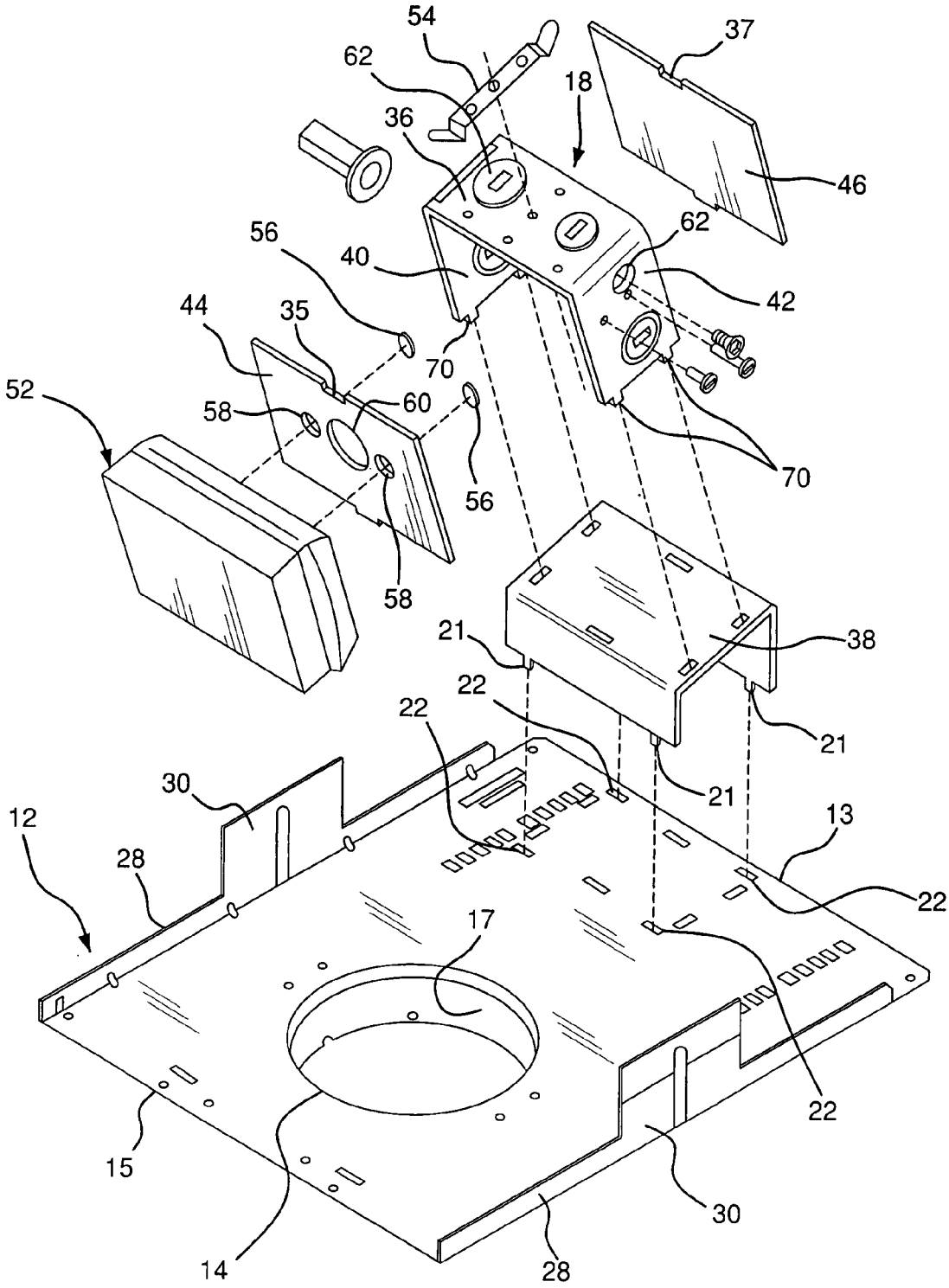
FIG. 2 is a top, exploded perspective view of the electrical box and mounting frame prior to assembly according to an embodiment of the present invention as seen in FIG. 1.

The lighting fixture assembly 10 is designed such that light exits the luminaire 16 through an opening 14 in the mounting frame 12. The mounting frame 12 is a substantially planar surface, such as a ceiling, and is substantially received in a first plane. As seen in FIG. 2, the mounting frame 12 includes a plurality of apertures 22 arranged thereon and preferably disposed at a first end 13 away from the opening 14, which is preferably disposed at a second end 15. The first end 13 and second end 15 are separated by two mounting frame side walls 28. The mounting frame side walls 28 extend upwardly from the horizontal orientation of the mounting frame 12. Optionally, the mounting frame 12 could be a plaster frame. The mounting frame 12 can be mounted in a floor or ceiling.

The opening 14 of the mounting frame 12 is substantially circularly-shaped for receiving a luminaire 16 with a reflector 24 and a socket cup 26. Any type of luminaire 16 could be used with the lighting fixture assembly 10. Any lighting fixture assembly 10 having an opening 14 sized to accommodate a luminaire 16 can be used. User access to the lighting fixture assembly 10 and the components thereof, once the lighting fixture assembly 10 is mounted to a floor or ceiling, is limited to the opening 14. Luminaire 16 is attached to the mounting frame 12. Essentially, any lighting fixture coupled to a mounting frame 12 having an opening 14 sized to accommodate that particular lighting fixture can be used. UL 1598 and CSA 22.2 Number 250 standards require that recessed lighting fixture assemblies 10 meet various inspection accessibility rules. For example, supply wires and the various contents of and devices mounted to the junction box 18 must be inspected from within the architectural space and be accessible for user maintenance.

Because electrical supply connections and, if electrical devices 52 are utilized, electrical device connections are contained in the junction box 18, it is important that the design of the junction box 18 enable inspectors, installers, and maintenance workers (henceforth referred to as end-users) to inspect and make electrical connections. Additionally, if an electrical device 52 is supplied, the inspectors and installers require access to the information printed on the electrical device 52 labels in addition to the information printed on the labels attached to the junction box 18. Additional electrical components of the lighting fixture assembly 10 that could require installation and inspection may include, but are not limited to, fuses, Radio Interference Filters, or quartz re-strike modules. Installers connect supply wires to the junction box 18 and connect those wires to the luminaire wires.

A wall 17 surrounding the opening 14 could include a plurality of clip springs 34 arranged thereon. The clip springs 34 are gripping tools for forming a tighter connection between the luminaire 16 and the mounting plate 12. Optionally, the clip springs 34 can be removed when a reflector 24 is installed therein. The luminaire 16 is secured in the opening 14 of the mounting frame 12 with clip springs 34 mounted to the plaster flange 17, yoke assemblies, or leaf springs.

The lighting fixture assembly 10 may be mounted, by utilizing a hanger bar assembly. The mounting frame 12 includes an adjustable mounting frame bracket 30 along each of the mounting frame side walls 28. The mounting brackets 30 are each coupled with the mounting frame side walls 28 and arranged substantially perpendicularly with respect to the planar surface of the mounting frame 12. A hanger bar bracket 32 is coupled to each mounting bracket 30. Each hanger bar bracket 32 is coupled with a hanger bar (not shown) that runs parallel to the mounting frame 12, which couples with the floor or ceiling construction, and includes arms 32 along its side that pivot away from the mounting frame 12. The side arms 32 control the adjustability of the mounting brackets because the arms 32 can pivot to accommodate various sized structures attached to the bracket 30.

Figure 3:
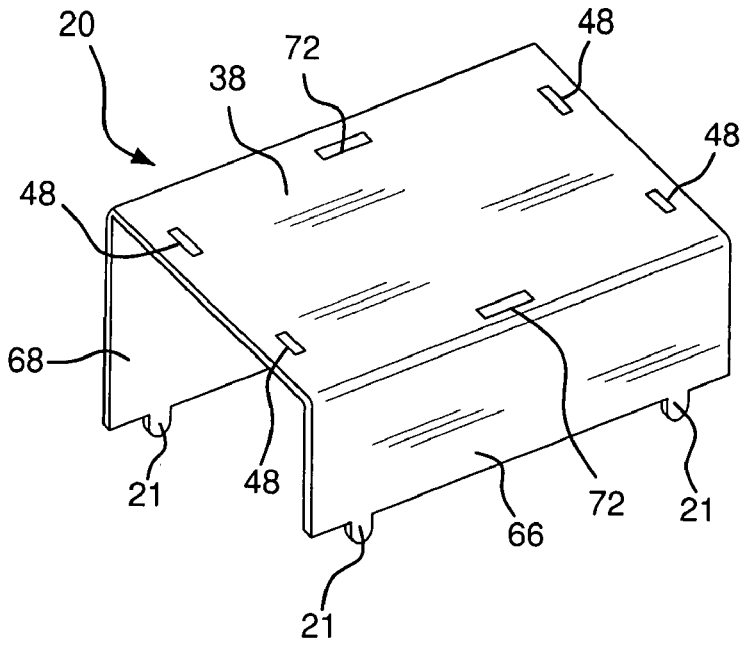
FIG. 3 is an enlarged side, perspective view of the mounting bracket according to an embodiment of the present invention as seen in FIGS. 1 and 2.
Figure 4:
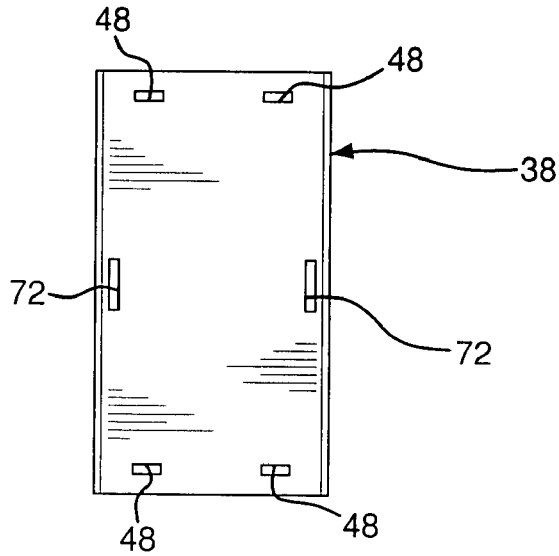
FIG. 4 is a top plan view of the mounting bracket as seen in FIG. 3.

As seen in FIG. 2, the junction box 18 includes a top wall 36, a bottom wall 38, first end wall 40, second end wall 42, first side wall 44, and second side wall 46. The top wall 36, first end wall 40, and second end wall 42 are together known as the electrical box 18 wrapper. In this exemplary embodiment, the bottom wall 38 is formed by the top of the mounting bracket 20. Most generally, the bottom wall 38 is formed by the main body 38 of the mounting bracket 20. However, the junction box 18 can have a bottom wall 38, which is independent of and non-integral to the mounting bracket 20. The bottom wall 38 includes a plurality of slots 48, 72, as best seen in FIGS. 3 and 4. Each of the first and second end walls 40, 42 and the first and second side walls 44, 46 includes at least one projection or tab 70 received in at least one of the slots 48. A connector 54 can secure the first and second side walls 44, 46 to the top wall 36 by the clipping of a first notch 35 of the first side wall 44 and a second notch 37 of a second side wall 46 to the top wall 36. The junction box 18, as seen in FIGS. 1, 2, and 7-10, is oriented angularly and supported in a tilted position with respect to the mounting frame 12. Preferably, the junction box 18 is tilted at an angle less than 90°.

The junction box 18 further includes an electrical power that is coupled to the luminaire 16 for delivering power to the luminaire 16 from a ballast or transformer 52 supported on the box. Electrical components such as a ballast or transformer may also be mounted in the junction box 18 depending on the type of luminaire. The ballast 52 is electrically coupled to the electrical power cord 50. As seen in FIG. 2, hardware such as a screw can be inserted into an opening 58 to connect the ballast 52 to the first side wall 44.

The junction box 18 also includes a plurality of knockouts 62 along the top wall 36, first end wall 40, and second end wall 42. The design details and measurements of the junction box 18 determine the size, shape, and location of the bracket 20.

As illustrated in FIG. 3, the mounting bracket 20 includes a main body 38, a first leg 66 coupled to the main body 38 and the mounting frame 12, and a second leg 68 also coupled to the main body 38 and the mounting frame 12. The main body 38 is substantially planar with each of the legs 66, 68 extending vertically downwardly and away from the planar main body. The main body 38 also acts as and supports the bottom wall 38 of the junction box 18. This configuration of the mounting bracket 20 forms a substantially U-shaped cross section.

Turning to FIGS. 3 and 4, the main body 38 further includes a plurality of slots 48, 72 adapted for receiving tabs 70 of the junction box 18. Preferably, each of the main body 38 corners includes a slot 48 oriented perpendicularly to the longitudinal side of the main body 38 and having a dimension of approximately 0.32"×0.100". Each of the longitudinal sides further includes a side slot 72 disposed perpendicularly to the corner slots 48 and located therebetween. The side slots 72 each have a dimension of approximately 0.10"×0.56". Preferably, the main body 38 includes four corner slots 48, and two side slots 72. The slots 48, 72, are sized to accommodate the tabs 70, projecting from the junction box 18. Each of the tabs 70 is received in the slots 48 of the U-shaped bracket 20. The side slots 72 receive the tabs 74 of the first and second side walls 44, 46. In an alternative embodiment the slots 48 are oriented substantially in parallel to the longitudinal side of the main body 38. In an alternative embodiment, the slots 48 are oriented at an angle to the longitudinal side of the main body 38.

The attachment of the junction box 18 to the mounting bracket 20 is not limited to this construction. There can be additional or fewer tabs 74 and tabs 70 constructed into the junction box 18. Also, the mounting bracket 20 can include bosses in place of the slots 48, 72. The junction box 18 may include slots in place of the tabs 74, 70. Additionally, fasteners or other components may be applied to couple the junction box 18 to the mounting bracket 20 in place of the tab/slot construction method.

As seen in FIG. 3, the first leg 66 of the mounting bracket 20 is smaller in length than the second leg 68. Each of the legs 66, 68 that will couple with the mounting frame 12 further includes at least one mounting bracket tab 21 extended from its edge proximal to the mounting frame 12 and received in one of the mounting frame apertures 22. The mounting bracket tabs 21 can be bent or flattened with respect to the legs 66, 68 or twisted for locking the mounting bracket 20 into place. The attachment of the mounting bracket 20 to the mounting frame 12 is not limited to this construction. The mounting frame 12 can include bosses in place of the mounting frame apertures 22. The mounting bracket 20 may include slots in place of the mounting bracket tabs 21. Additionally, fasteners or other components may be applied to couple the mounting bracket 20 to the mounting frame 12 in place of the tab/slot construction method.

Figure 5:
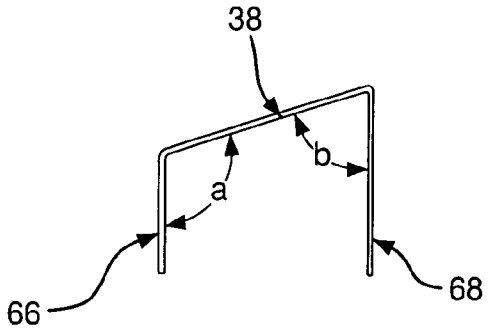
FIG. 5 is a right side elevational view of the mounting bracket as seen in FIG. 3.
Figure 6:
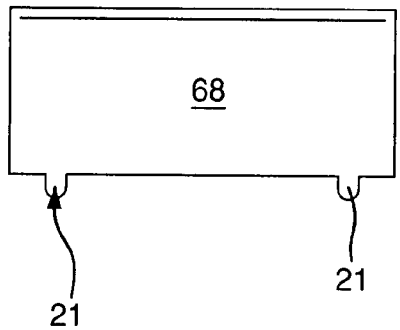
FIG. 6 is a rear elevational view of the mounting bracket as seen in FIG. 3.
Figure 7:
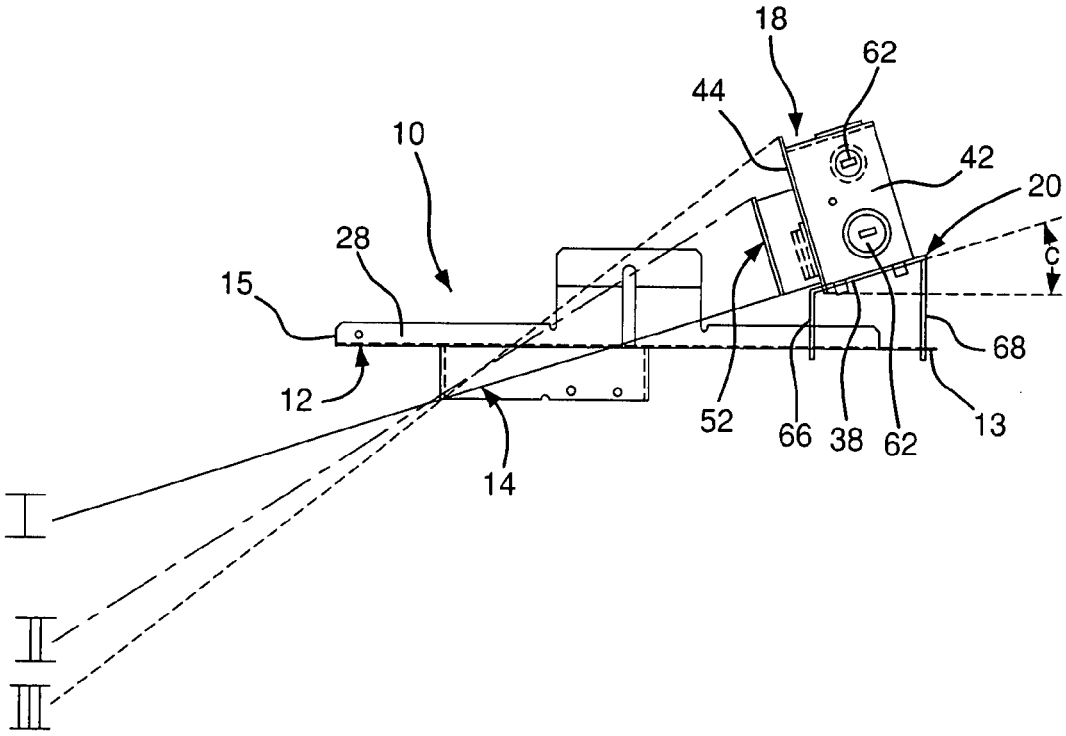
FIG. 7 is a side elevational view of the lighting fixture assembly before the luminaire is attached as seen in FIG. 1.

Preferably, the first leg 66 is closer to the opening 14 than the second leg 68. This orientation positions the substantially U-shaped mounting bracket 20 in a tilted position towards the opening 14. As seen in FIG. 5, the first leg 66 is coupled to the main body 38 at an angle "a" of about 104° to about 110°, and preferably about 107°, and the second leg 68 is coupled to the main body 38 at an angle "b" of about 70° to about 76°, and preferably about 73°. Moreover, bracket 20 also elevates the junction box 18 from the mounting frame 12. With this alignment, the main body 38 forms an acute angle with the first plane containing the mounting frame 12 and any plane parallel thereto. As illustrated in FIG. 7, the acute angle "c" is preferably about 17°. The angle "c" could also be between about 14° and about 20°.

Figure 9:
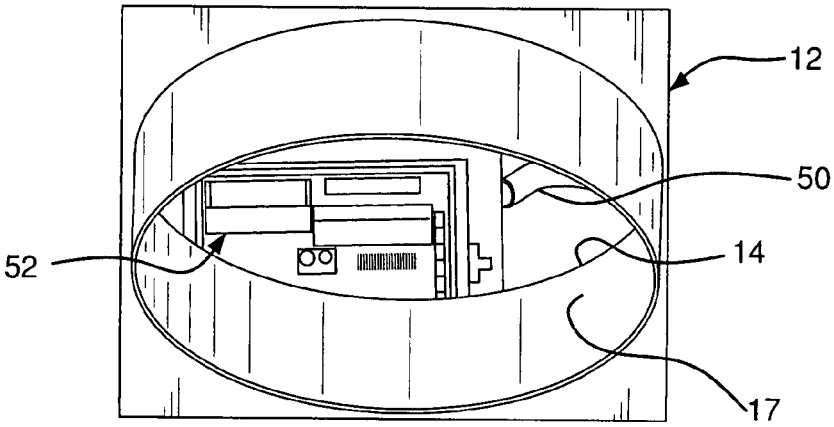
FIG. 9 is a bottom perspective view of the electrical box and the contents thereof as seen through an opening in the mounting frame without the luminaire located in the opening of the mounting frame of the lighting fixture assembly in FIGS. 1-8.
Figure 10:
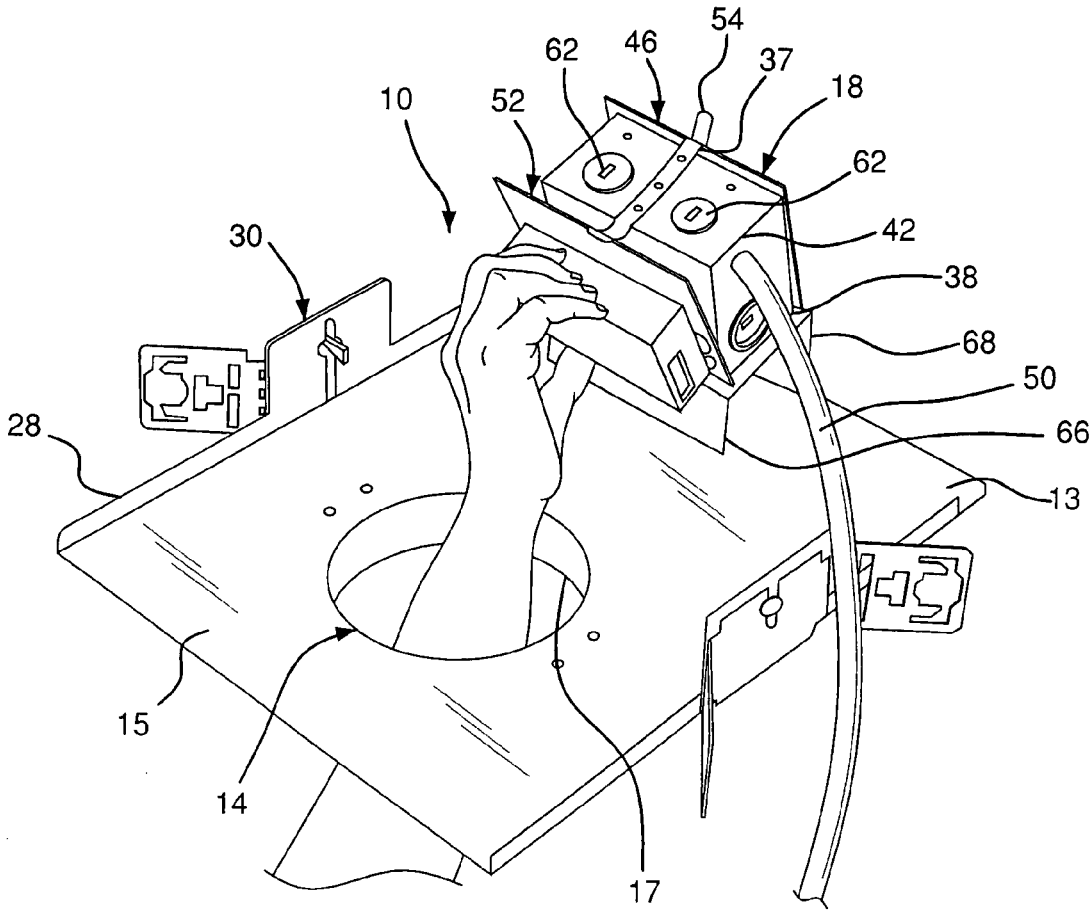
FIG. 10 is a top perspective view of the lighting fixture assembly with a user engaging a ballast through the opening in the mounting frame according to the embodiment seen in FIGS. 1-9.

By elevating the junction box 18 from the planar surface of the mounting frame 12, the area of the electrical device 52 that can be viewed through the opening 14 in the mounting frame 12 from below the mounting frame 12 is maximized, as seen in FIG. 9. This positioning of the junction box 18 enables end-users to have optimal visibility of and access to the junction box 18 and its interior. Thus, the dimensions of the opening 14, the location of the opening 14 in the mounting frame 12, and the dimensions of the mounting frame 12 will determine the details of the size, shape, and location on the mounting frame 12 of the mounting bracket 20.

This concept is best illustrated by FIG. 7 whereby lines I, II, and III relate to views as seen by an end-user. The mounting bracket 20 is located on the mounting frame 12. From the architectural space beneath the opening 14, one would move their eye between Lines I and III to view the entire electrical box 18 door or first side wall 44. As the line of vision moves between Lines I and II, the entire face of the electrical device 52 is visible. In alternative embodiments, the mounting bracket 20 could be repositioned on the mounting frame 12, the angle of the mounting bracket 20 tilt could be increased or decreased, and the height of the mounting bracket 20 measured off of the mounting frame 12 could be increased or decreased based on the changes in length of the first and second legs 66, 68.

Figure 11:
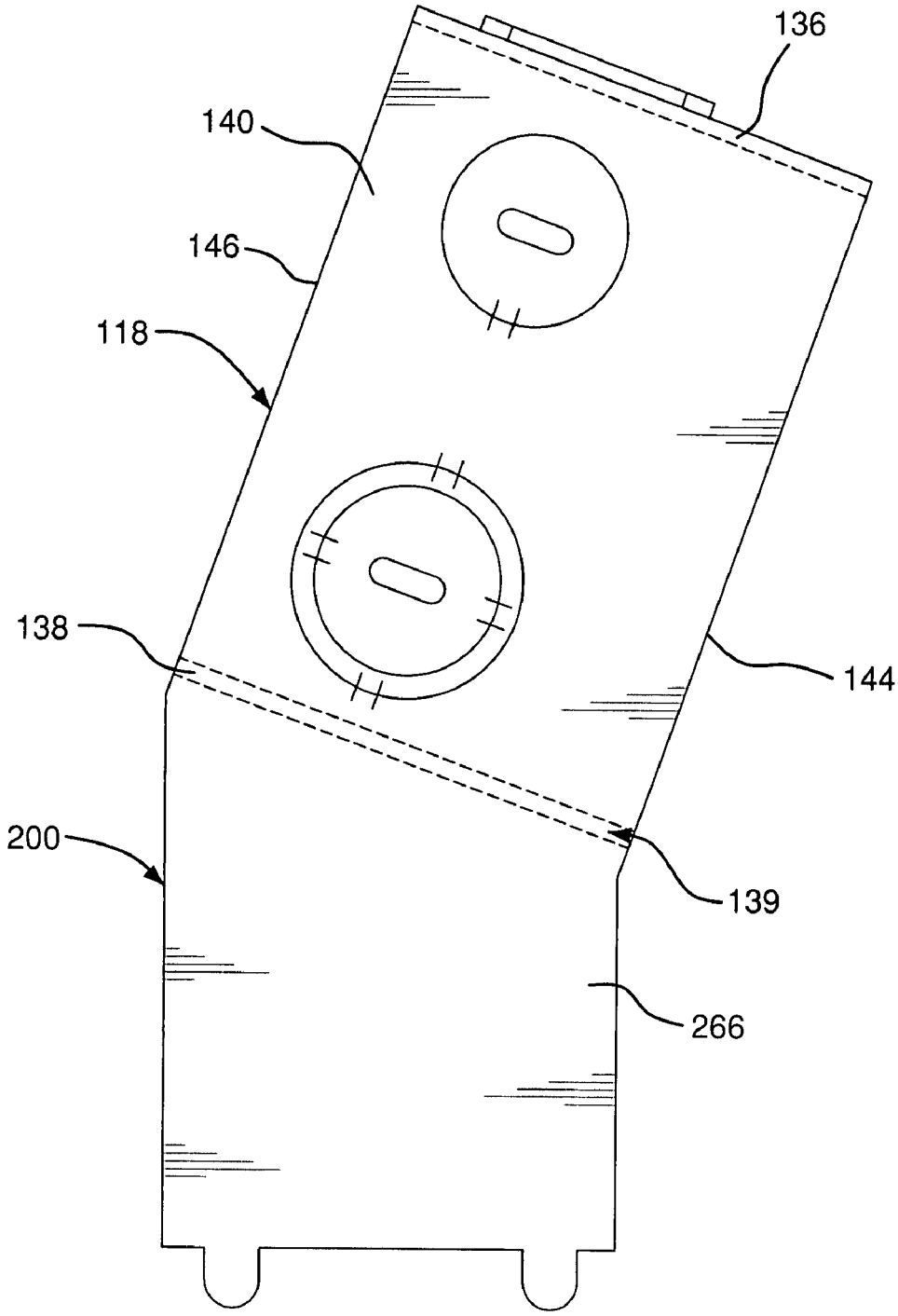
FIG. 11 is an enlarged side elevational view of the mounting bracket according to an alternative embodiment in which the legs of the mounting bracket are integrally formed with the sides of the electrical box.

In an alternative embodiment seen in FIG. 11, the electrical box 118 includes a top wall 136, a bottom wall 138, first end wall 140, second end wall, first side wall 144, and second side wall 146. The mounting bracket 200 includes a first leg 266 coupled to the first end wall 140 and a second leg coupled to the second end wall. The mounting bracket 200 is formed by the bottom wall 138, which is coupled to the first leg 266 and the second leg forming a substantially U-shaped bracket. A plate 139, or other such component, can be added without departing from the scope of the invention. A plate 139 can represent the bottom wall 138 of the electrical box 118 where the plate 139 would support the front wall 144 and the rear wall 146. A plate 139 can be a component between the first leg 266 and the second leg such that the three parts taken together make up the mounting bracket 200 without also being the bottom wall 138 of the electrical box 118. Multiple plates 139 can be applied in the design. In FIG. 11, a plate 139 is shown as both the bottom wall 138 and the top of the mounting bracket 200. This plate 139 will support the front wall 144 and the rear wall 146.

Given this orientation, the first leg 266 is integrally formed with the first end wall 140 and the second leg is integrally formed with the second end wall. Thus, the first leg 266 forms an obtuse angle with the first end wall 140 and the second leg forms an obtuse angle with the second end wall. Each of the obtuse angles is about 163°, but they could be between about 160° and about 166°. These obtuse angles do not have to match.

Another alternative with respect to the mounting bracket 20 is a multi-position mounting bracket 20 having a plurality of tilt angles. This type of mounting bracket 20 would most likely include at least one hinge for enabling the possible tilt angles. In another embodiment, the length of each of the first and second legs can be changed to alter the tilt angle. It could also be possible to support a single leg mounting bracket 20 with additional components. If the material of the mounting bracket 20 is sturdier or thicker than that of the preferred embodiment, the single leg mounting bracket 20 could stand without additional supporting fasteners or structures. Another alternative embodiment is to add strengthening structural features in the mounting bracket 20 to enable a single leg mounting bracket 20 to stand without additional support. Another alternative embodiment is to make the mounting bracket a solid block or a mostly solid block where the main body 38 forms an acute angle with the first plane containing the mounting frame 12 and any plane parallel thereto and tilts the junction box 18 towards the opening 14 in the mounting frame 12.

As seen in FIG. 9, the lighting fixture assembly 10 is considered to be optimally visible through the opening 14 from below the mounting frame 12 because the parameters of the mounting bracket 20 are optimized, which leads to the optimization of the orientation of the junction box 18 in relation to the opening 14. This allows end-users to view the various specifications of the electrical device 52 through the opening 14. The end-user has a more perpendicular view of the electrical device 52 than would be possible with the construction methods for conventional recessed lighting fixture assemblies. As demonstrated in FIG. 10, the orientation of the junction box 18 is optimized to allow an end-user to insert an arm into the opening 14 and access the electrical device 52 and junction box 18 readily from below the mounting frame 12.

While a particular embodiment has been chosen to illustrate the invention, it will be understood by those skilled in the art that various changes and modifications can be made therein without departing from the scope of the invention as defined in the appended claims.

What is claimed is:

1. A lighting fixture assembly, the combination comprising:

a mounting frame adapted to be coupled to a wall in an architectural space and having an opening therein;

a luminaire coupled to said mounting frame for projecting light through said opening;

an electrical box; and a support, coupled to said mounting frame and to said electrical box, for supporting said electrical box in a position tilted towards said opening for easy access and viewing through said opening from below said mounting frame.

2. A lighting fixture assembly according to claim 1, wherein said support comprises a bracket having a main body supporting said electrical box, a first leg coupled to said main body and to said mounting frame, and a second leg coupled to said main body and to said mounting frame, said first leg having a length smaller than the length of said second leg.

3. A lighting fixture assembly according to claim 2, wherein said bracket has a substantially U-shaped transverse cross section.

4. A lighting fixture assembly according to claim 2, wherein said first leg is closer to said opening than said second leg.

5. A lighting fixture assembly according to claim 2, wherein said mounting frame is substantially received in a first plane, and said main body forms an acute angle with said first plane.

6. A lighting fixture assembly according to claim 5, wherein said acute angle is about 17°.

7. A lighting fixture assembly according to claim 5, wherein said acute angle is about 14° to about 20°.

8. A lighting fixture assembly according to claim 2, wherein said mounting frame has a plurality of apertures, and each of said first and second legs has at least one tab received in one of said apertures.

9. A lighting fixture assembly according to claim 2, wherein said main body is substantially planar.

10. A lighting fixture assembly according to claim 1, wherein said box has a top wall, a bottom wall, first and second end walls, and first and second side walls, said bottom wall is formed by said bracket.

11. A lighting fixture assembly according to claim 10, wherein said bottom wall has a plurality of slots and each of said first and second end walls and first and second side walls has at least one projection received in one of said slots.

12. A lighting fixture assembly according to claim 1, wherein said electrical box has a top wall, a bottom wall, first and second end walls, and first and second side walls, a first leg is coupled to said first end wall, and a second leg is coupled to said second end wall, said support being formed by said bottom wall and said first and second legs.

13. A lighting fixture assembly according to claim 12, wherein said first leg is integrally formed with said first end wall, and said second leg is integrally formed with said second end wall, said first leg forms an obtuse angle with said first end wall, and said second leg forms an obtuse angle with said second end wall.

14. A lighting fixture according to claim 13, wherein each of said obtuse angles is about 163°.

15. A lighting fixture according to claim 13, wherein each of said obtuse angles is about 160° to about 166°.

16. A lighting fixture assembly according to claim 1, wherein said electrical box is supported in a tilted position at an angle less than 90°.

17. A lighting fixture assembly, the combination comprising:

a mounting frame adapted to be coupled to a wall in an architectural space and having an opening therein;

a luminaire coupled to said mounting frame for projecting light through said opening;

an electrical box having an electrical power cord coupled to said luminaire for delivering power to said luminaire, an electrical device located therein and electrically coupled to said electrical power cord, and an aperture therein adapted to receive an electrical power conduit adapted to be electrically coupled to said electrical device and a support, coupled to said mounting frame and to said electrical box for supporting said electrical box in a position tilted towards said opening at an angle less than 90° for easy access and viewing through said opening below said mounting frame.

18. A lighting fixture assembly according to claim 17, wherein said support has a main body supporting said electrical box, a first leg coupled to said main body and to said mounting frame, and a second leg coupled to said main body and to said mounting frame, said first leg having a length smaller than the length of said second leg.

19. A lighting fixture assembly according to claim 17, wherein said box has a top wall, a bottom wall, first and second end walls, and first and second side walls, said bottom wall is formed by said bracket.

20. A lighting fixture assembly according to claim 19, wherein said bottom wall has a plurality of slots, and each of said first and second end walls and first and second side walls has at least one projection received in one of said slots.

* * * * *